US006378968B1

(12) United States Patent
Weng

(10) Patent No.: US 6,378,968 B1
(45) Date of Patent: Apr. 30, 2002

(54) SLIDING TRACK ASSEMBLY

(76) Inventor: Kuo-Chan Weng, No. 196-6, Hsin Chuang Li, Tuku Chen, Yun Lin Hsien (TW)

( * ) Notice: Subject to any disclaimer, the term of this patent is extended or adjusted under 35 U.S.C. 154(b) by 0 days.

(21) Appl. No.: 09/547,857

(22) Filed: Apr. 12, 2000

Related U.S. Application Data

(63) Continuation-in-part of application No. 09/326,536, filed on Jun. 7, 1999, now Pat. No. 6,056,379.

(51) Int. Cl.[7] ..... A47B 88/00
(52) U.S. Cl. ..... 312/334.11; 312/334.17
(58) Field of Search ..... 312/334.1, 334.7, 312/334.8, 334.9, 334.11, 334.13, 334.17, 334.32, 334.33, 334.38, 330.1; 384/18, 19, 20

(56) References Cited

U.S. PATENT DOCUMENTS 2,606,090 A * 8/1952 Straubel ..... 312/334.11
2,675,277 A * 4/1954 McClellan ..... 312/334.11 X
3,059,978 A * 10/1962 Fall ..... 312/334.11 X
4,469,384 A * 9/1984 Fler et al. ..... 312/334.11 X
5,472,272 A * 12/1995 Hoffman ..... 312/334.11
5,551,775 A * 9/1996 Parvin ..... 312/334.33 X
5,851,059 A * 12/1998 Cirocco ..... 312/334.11
5,895,101 A * 4/1999 Cabrales et al. ..... 312/334.11

FOREIGN PATENT DOCUMENTS

GB 935266 * 8/1963 ..... 312/334.33

* cited by examiner

*Primary Examiner*—James O. Hansen
(74) *Attorney, Agent, or Firm*—Troxell Law Office PLLC

(57) ABSTRACT

Sliding track assembly, including an outer slide rail, a middle slide rail, an inner slide rail and at least one transmission section disposed on the middle slide rail. The outer slide rail is disposed on a cabinet. The middle slide rail is slidably positioned in the outer slide rail. The inner slide rail is disposed on a drawer and slidably positioned in the middle slide rail. The transmission section is disposed with at least one stop section and transmission member disposed at the stop section. The stop section is disposed at predetermined portion of the middle slide rail, whereby the transmission member can respectively contact with predetermined portions of the outer slide rail and inner slide rail. When the inner slide rail slides, the transmission member simultaneously drives the stop section of the middle slide rail. Therefore, the middle and the outer slide rails and the middle and inner slide rails are synchronously slid relative to each other.

17 Claims, 6 Drawing Sheets

SLIDING TRACK ASSEMBLY

This application is a continuation-in-part of application Ser. No. 09/326,536, entitled SLIDING TRACK ASSEMBLY, filed on Jun. 7, 1999 now U.S. Pat. No. 6,056,379.

BACKGROUND OF THE INVENTION

The present invention relates to a slide rail structure disposed between two articles, and more particularly to a sliding track assembly applied to drawers and file cabinets.

Conventionally, two corresponding rails are arranged between a drawer and a cabinet for easily pushing and pulling the drawer within the cabinet. In addition, stop blocks such as projecting blocks or projecting plates are disposed at the rails to avoid separation of the drawer from the cabinet Moreover, the drawer is generally designed with a considerable longitudinal length for increasing the capacity. In addition, as shown in FIG. 1, the drawer is further disposed with three rails including a cabinet slide rail A, a second slide rail B, a drawer slide rail C and stop blocks respectively disposed at one end or two ends of the respective slide rails. Therefore, the drawer can be totally drawn out of the cabinet without separating from the rails and after the articles are taken out, the drawer can be immediately pushed into the cabinet. The slide rails are slidably assembled with each other and the stop blocks stop each other, whereby the drawer can be entirely drawn out of the cabinet without detaching from the cabinet and dropping down. Ball bearings D are disposed between the slide rails for reducing the frictional force therebetween and lowering the noise during sliding.

According to the above arrangement, when drawing the drawer outside the cabinet, that is, when pulling the drawer slide rail C, due to the ball bearing D between the slide rails, the following operation will take place:

First condition: Only the drawer slide rail C is slid out of the second slide rail B, while the second slide rail B remains still. Certainly, the cabinet slide rail A mounted on the cabinet is always still. After the drawer slide rail C is pulled and the stop block thereof hits and engages with the stop block at one end of the second slide rail B, the second slide rail B starts to further slide out of the cabinet slide rail A along with the drawer slide rail C. After the second slide rail B is pulled to engage the stop block thereof with the stop block at one end of the cabinet slide rail A, the second slide rail B and the drawer slide rail C are stopped.

Second condition: When the drawer slide rail C is slid out, the second slide rail B is simultaneously driven to slide. The cabinet slide rail A is always still. After the second slide rail B is moved and the stop block thereof hits and engages with the stop block at one end of the cabinet slide rail A, the second slide rail B is stopped, while the drawer slide rail C further slides out from the second slide rail B. After the drawer slide rail C is pulled to engage the stop block thereof with the stop block at one end of the second slide rail B, the drawer slide rail C is stopped.

Third condition: When the drawer slide rail C slides, sometimes the second slide rail B will slide along with the drawer slide rail C, while sometimes it remains still. The stop block of the drawer slide rail C will first hit and engage with the stop block of the cabinet slide rail A.

Accordingly, in the case that the conditions that the drawer is totally pulled out or totally pushed are not considered, during reciprocating of the drawer slide rail C, one type of collision will take place. The drawer slide rail C will hit the stop block of the second slide rail B or the second slide rail B will hit the stop block of the cabinet slide rail A. To a user, when not totally pulling out the drawer or pushing the drawer, the user will feel the hit once and suffer a feeling of resistance or unsmoothness. Moreover, in the case a greater force is applied to the drawer, an unpleasing noise will be produced and the structure of the drawer will suffer a collision. This shortens the using life of the slide rail.

SUMMARY OF THE INVENTION

It is therefore a primary object of the present invention to provide a sliding track assembly, which avoids collision between slide rails when drawing or pushing a drawer.

It is a further object of the present invention to provide the above sliding tack assembly, which enables the drawer to be drawn or pushed more smoothly.

It is still a further object of the present invention to provide the above sliding track assembly, by which the using life of the slide rail is prolonged.

The present invention can be best understood through the following description and accompanying drawings wherein:

DETAILED DESCRIPTION OF THE PREFERRED EMBODIMENTS

Figure 1:
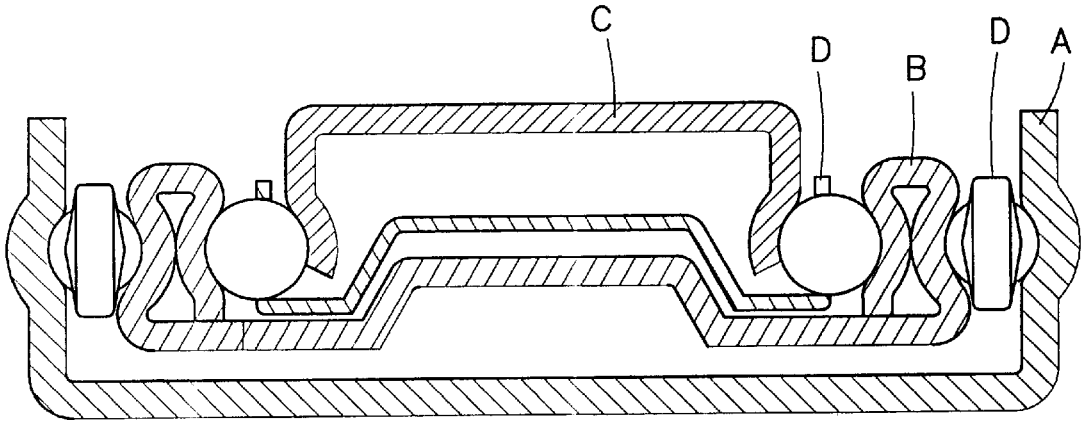
FIG. 1 Prior art
FIG. 1 is a sectional view of a conventional sliding track assembly.
Figure 2:
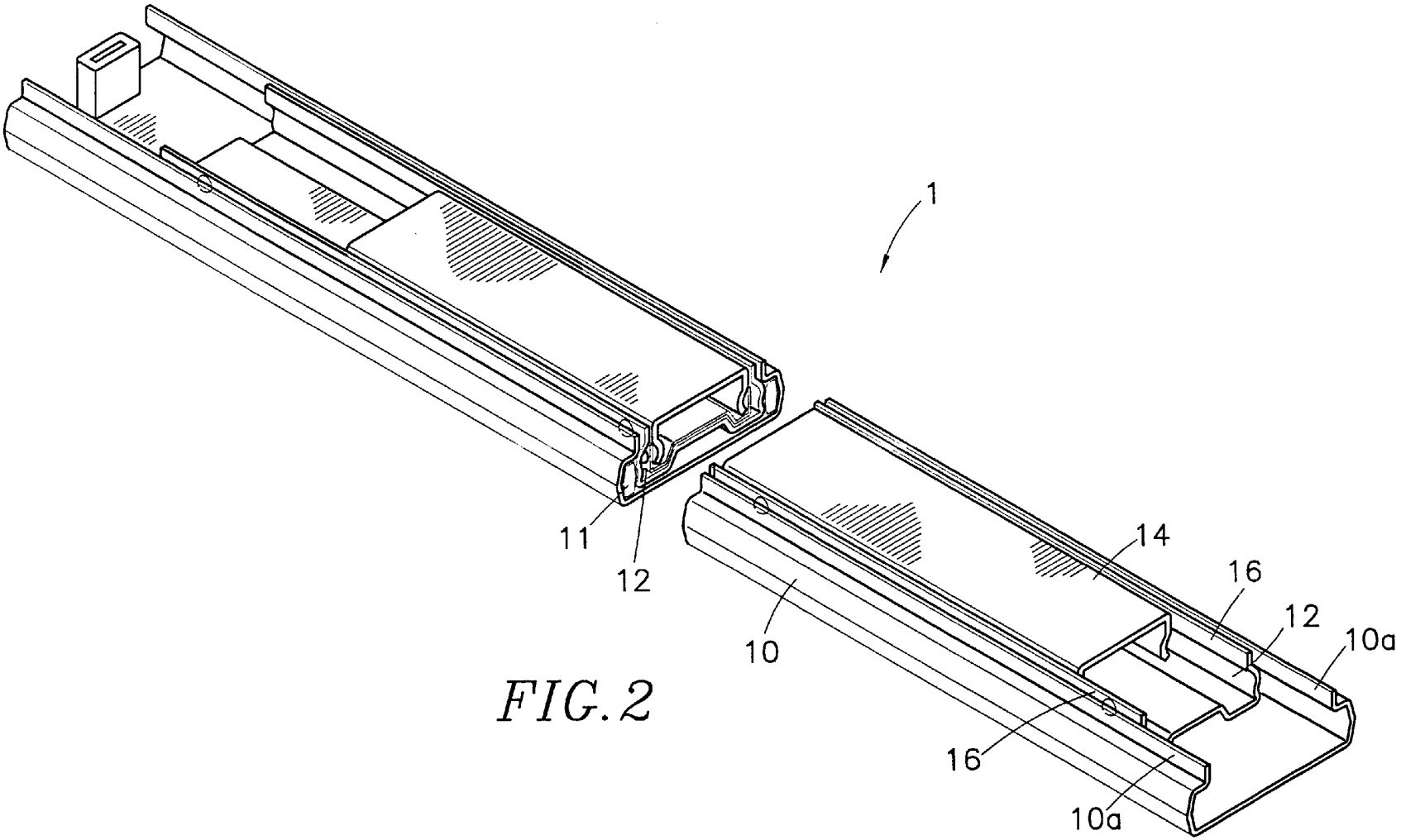
FIG. 2 is a perspective assembled view of a first embodiment of the present invention.
Figure 3:
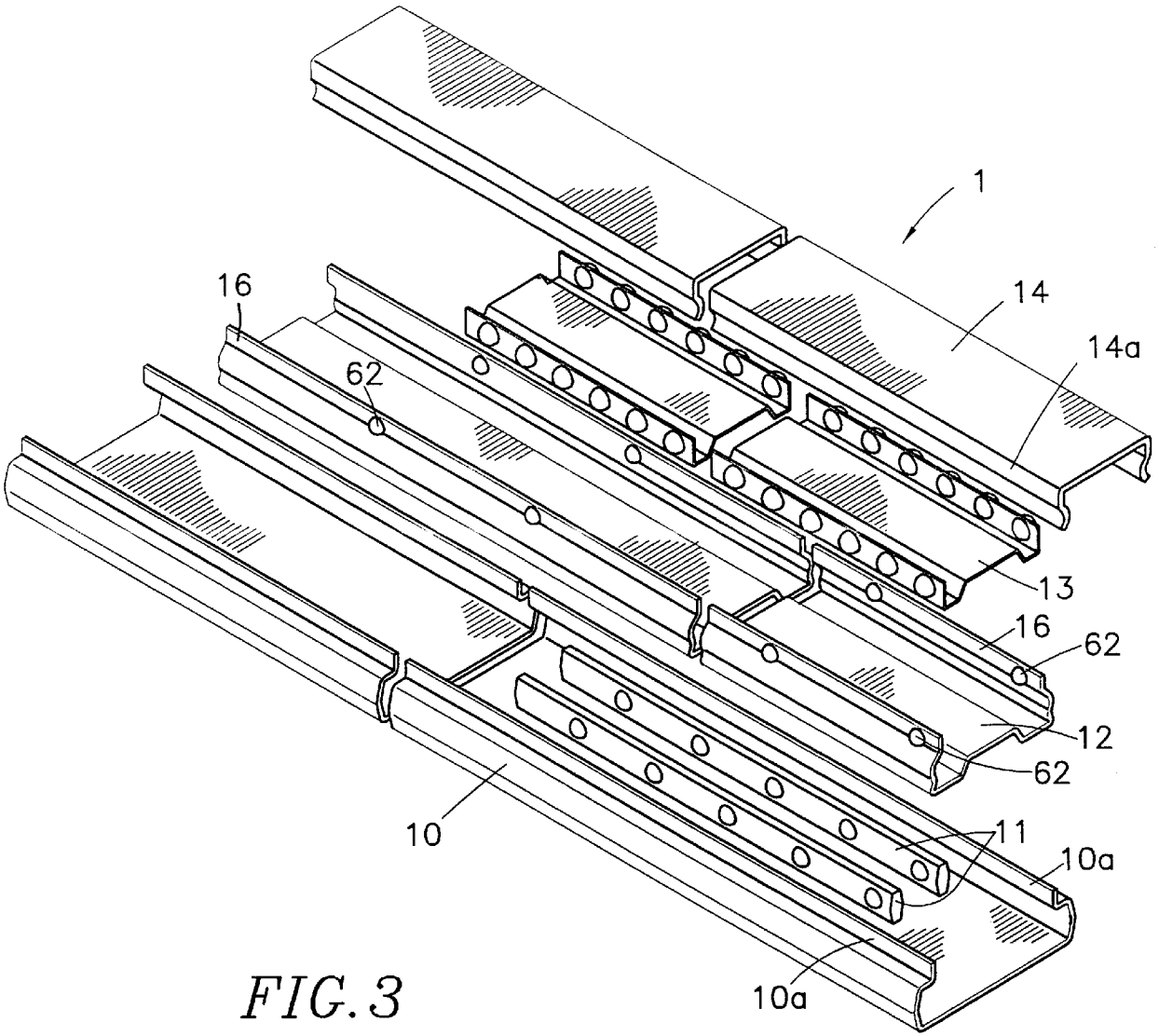
FIG. 3 is a perspective exploded view of the first embodiment of the present invention.
Figure 4:
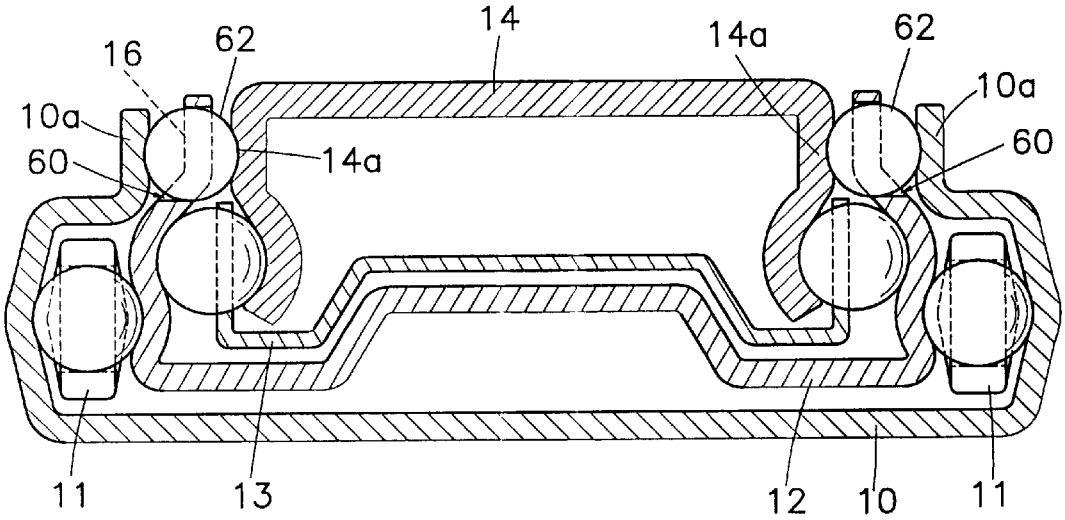
FIG. 4 is a sectional view of the first embodiment of the present invention.
Figure 5:
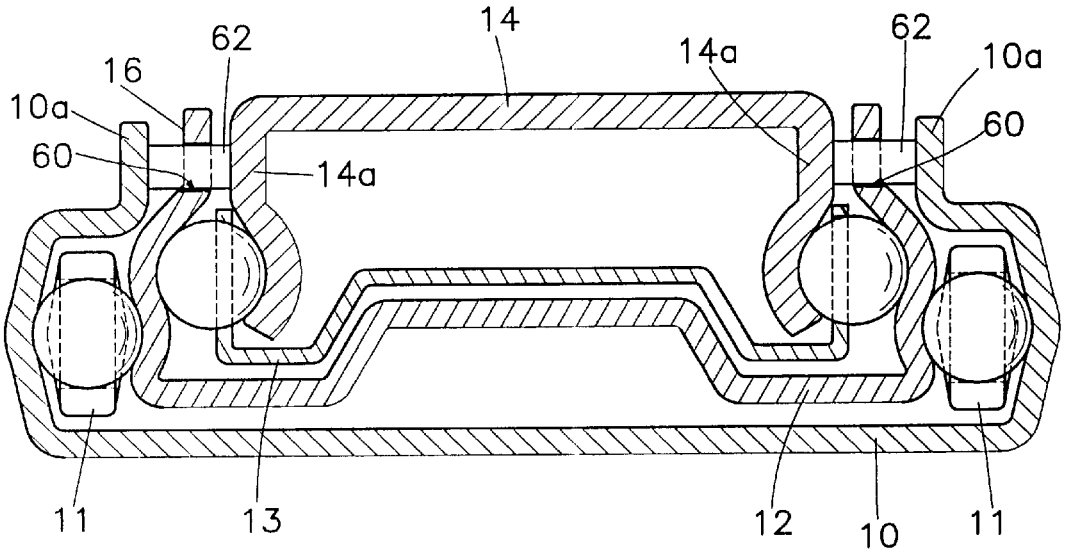
FIG. 5 is a sectional view of the second embodiment of the present invention.

Please refer to FIGS. 2 to 5. The synchronizing structure 1 of extensible rail of the present invention includes an outer slide rail 10, a middle slide rail 12, an inner slide rail 14 and two transmission sections 16. A first ball bearing assembly 11 is disposed between the outer slide rail 10 and the middle slide rail 12. A second ball bearing assembly 13 is disposed between the middle slide rail 12 and the inner slide rail 14.

The outer slide rail 10 is a channel body with a predetermined length. Two lateral sides thereof are formed with spherical ball rails with C-shaped cross-section. Two first frictional sections 10*a* are formed on the spherical ball rails and extend toward the middle slide rail 12 by a predetermined distance.

The middle slide rail 12 is a channel body with a predetermined length. Two lateral sides thereof are formed with spherical ball rails with C-shaped cross-section.

The two transmission sections 16 are disposed on two lateral faces of the middle slide rail 12 and upward extend from the spherical ball rails by a predetermined height. A predetermined portion of the transmission section is disposed with at least one perforated stop section 60 and rotary transmission member 62 such as ball or roller for inserting into the stop section 60. The transmission member 62 is partially exposed outside two lateral sides of the stop section 60 to lean against the first frictional section 10*a*.

The inner slide rail 14 is a channel body with a predetermined length. Two lateral sides thereof are formed with spherical ball rails with C-shaped cross-section. Two second frictional sections 14*a* are formed on the spherical ball rails and extend toward the middle slide rail 12 by a predetermined distance and lean against the transmission member 62.

When pulling or pushing the inner slide rail 14 to slide, the second frictional sections 14*a* of the inner slide rail 14 will drive the transmission members 62 to rotate. The transmission members 62 lean against the first frictional sections 10*a* of the stationary outer slide rail 10 so that the rotary transmission members 62 will at the same time pull and push the middle slide rail 12 to slide. Therefore, the inner slide rail 14 and the middle slide rail 12 synchronously slide.

According to the above arrangement, the present invention has the following advantages:

1. The inner slide rail 14 and the middle slide rail 12 synchronously slide. Therefore, in the not totally reciprocally outward pulling or inward pushing of the drawer, the slide rails are prevented from colliding with each other so that the drawer can be more smoothly pulled and pushed.

2. The collision between the slide rails is avoided so that the using life of the product is prolonged.

Figure 6:
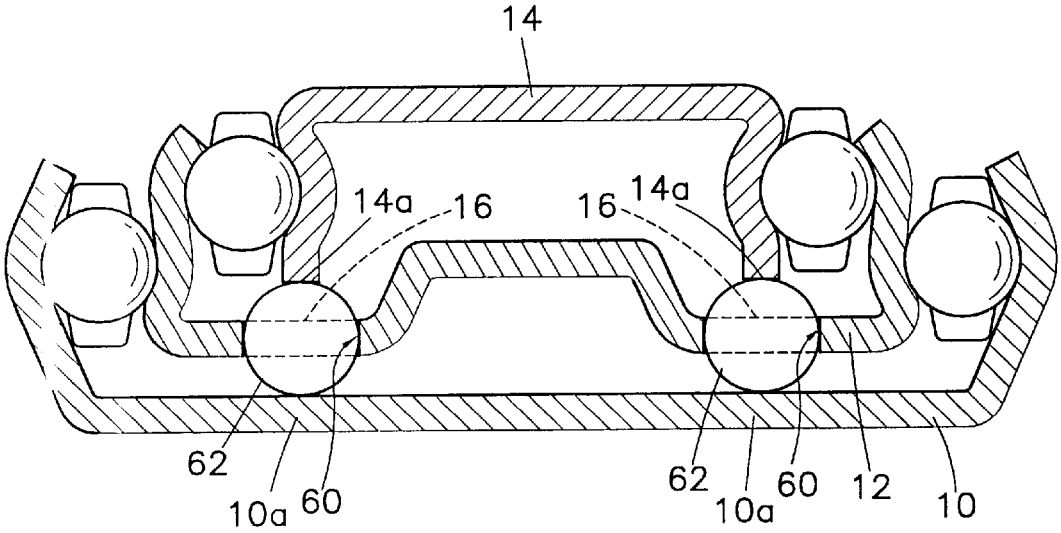
FIG. 6 is a sectional view of the third embodiment of the present invention.

Referring to FIG. 6, alternatively, the transmission sections 16 are disposed at predetermined portions of the bottom face of the middle slide rail 12. The first frictional sections 10*a* are disposed at predetermined portions of the inner side of bottom face of the outer slide rail 10. The second frictional sections 14*a* are disposed on top edges of lateral faces of the inner slide rail 14.

Figure 7:
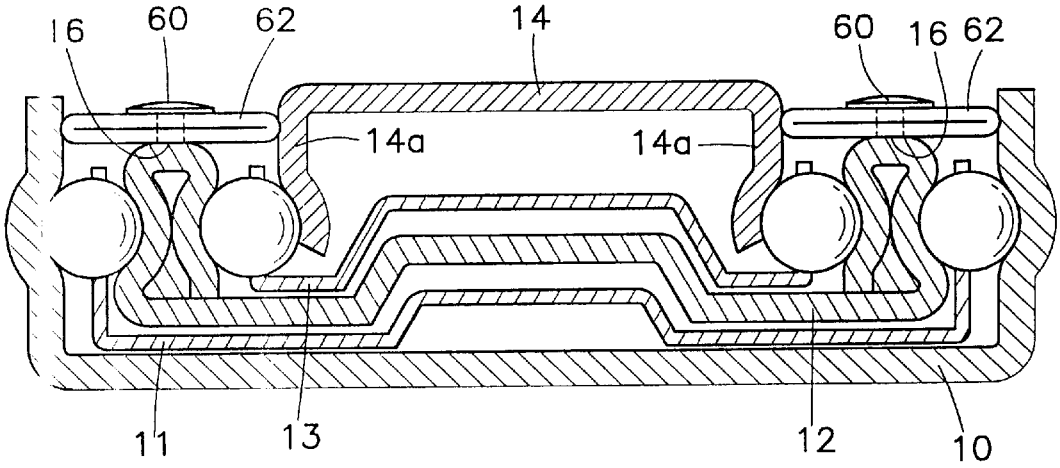
FIG. 7 is a sectional view of the forth embodiment of the present invention.

Referring to FIG. 7, alternatively, the transmission sections 16 are disposed on top edges of lateral faces of the middle slide rail 12. The stop section 60 is a shaft rod one end of which has a parachute-shaped fixing block. The other end thereof is fixedly connected with the top edge of the lateral face of the middle slide rail 12 and pivotally connected with a disc-shaped transmission member 62.

Furthermore, there can be only one transmission section 16 in the present invention.

Figure 8:
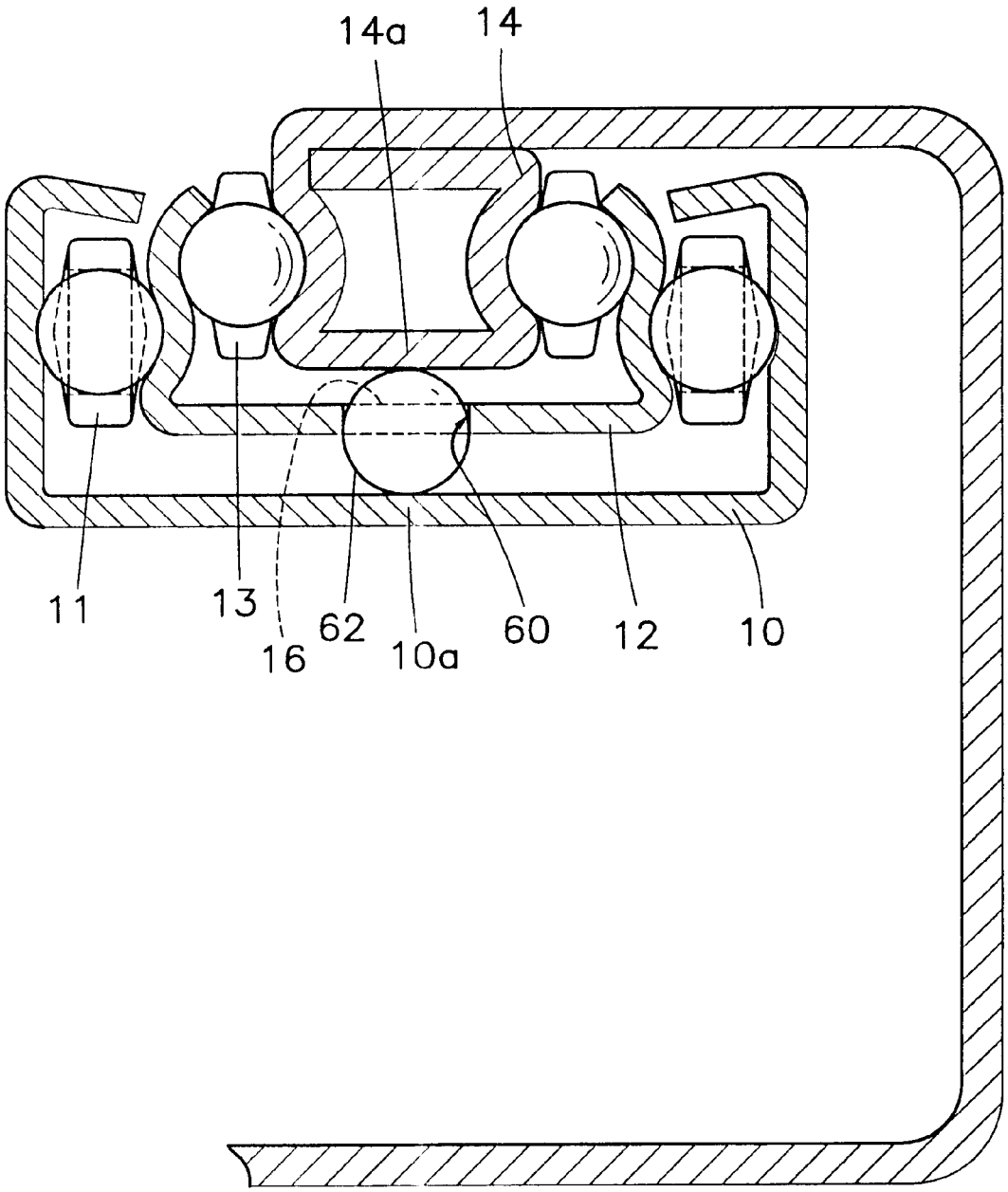
FIG. 8 is a sectional view of the fifth embodiment of the present invention.

Referring to FIG. 8, there are only one transmission section 16 and a first frictional section 10*a* which are respectively positioned at a predetermined portion of the bottom face of the middle slide rail 12 and a predetermined portion of inner side the bottom face of the outer slide rail 10. The inner slide rail 14 is positioned in the middle slide rail 12 and shaped as a hollow rectangular body. The second frictional section 14*a* is disposed on one face of the inner slide rail corresponding to the bottom face of the middle slide rail 12.

The above embodiments are only used to illustrate the present invention, not intended to limit the scope thereof. Many modifications of the above embodiments can be made without departing from the spirit of the present invention.

What is claimed is:

1. A sliding track assembly, comprising:

an outer slide rail including a first channel body formed with first spherical ball rails, the outer slide rail having at least one first frictional section;

a middle slide rail slidably mounted on the outer slide rail, the middle slide rail including a second channel body formed with second spherical ball rails, the middle slide rail having at least one transmission section;

an inner slide rail slidably mounted on the middle slide rail and including a third channel body formed with third spherical ball rails, the inner slide rail having at least one second frictional section;

a first ball bearing assembly disposed between the first and second spherical ball rails of the outer slide rail and the middle slide rail;

a second ball bearing assembly disposed between the second and third spherical ball rails of the middle slide rail and the inner slide rail;

at least one stop section located on a predetermined portion of the at least one transmission section; and a transmission member rotatably located on the at least one stop section and bearing against the first and second frictional sections.

2. The sliding track assembly as claimed in claim 1, wherein: the transmission section is located on a lateral face of the middle slide rail; the first frictional section is located on a lateral face of the outer slide rail; and the second frictional section is located on a lateral face of the inner slide rail.

3. The sliding track assembly as claimed in claim 2, wherein the stop section has perforations and the transmission member comprises ball members located in the perforations.

4. The sliding track assembly as claimed in claim 2, wherein the stop section has perforations and the transmission member comprises rollers located in the perforations.

5. The sliding track assembly as claimed in claim 2, wherein: the transmission section is located on a top edge of the lateral face of the middle slide rail; the at least one stop section comprising a shaft rod having a fixing block, and being fixedly connected with the top edge of the lateral face of the middle slide rail and pivotally connected with a disc-shaped transmission member.

6. The sliding track assembly as claimed in claim 1, wherein: the transmission section is located on a bottom face of the middle slide rail; the first frictional section is located on a bottom face of the outer slide rail; and the second frictional section is located on a face of the inner slide rail.

7. The sliding track assembly as claimed in claim 6, wherein the inner slide rail is positioned in the middle slide rail and has a hollow rectangular shape, and the second frictional section is located on a face of the inner slide rail adjacent to the bottom face of the middle slide rail.

8. The sliding track assembly as claimed in claim 7, wherein the stop section has perforations and the transmission member comprises ball members located in the perforations.

9. The sliding track assembly as claimed in claim 7, wherein the stop section has perforations and the transmission member comprises rollers located in the perforations.

10. The sliding track assembly as claimed in claim 6, wherein the stop section has perforations and the transmission member comprises ball members located in the perforations.

11. The sliding track assembly as claimed in claim 6, wherein the stop section has perforations and the transmission member comprises rollers located in the perforations.

12. The sliding track assembly as claimed in claim 1, wherein: the first frictional section is located on a lateral face of the outer slide rail which extends toward the middle slide rail; the second friction section is located on a lateral face of the inner slide rail which extends toward the middle slide rail.

13. The sliding track assembly as claimed in claim 12, wherein the stop section has perforations and the transmission member comprises ball members located in the perforations.

14. The sliding track assembly as claimed in claim 12, wherein the stop section has perforations and the transmission member comprises rollers located in the perforations.

15. The sliding track assembly as claimed in claim 12, wherein the transmission section is located on a top edge of a lateral face of the middle slide rail; the at least one stop section comprising a shaft rod having a fixing block, and being fixedly connected with a top edge of a lateral face of the middle slide rail and pivotally connected with a disc-shaped transmission member.

16. The sliding track assembly as claimed in claim 1, wherein the stop section has perforations and the transmission member comprises ball members located in the perforations.

17. The sliding track assembly as claimed in claim 1, wherein the stop section has perforations and the transmission member comprises rollers located in the perforations.

* * * * *